US010570785B2

(12) United States Patent
McCLoy et al.

(10) Patent No.: US 10,570,785 B2
(45) Date of Patent: Feb. 25, 2020

(54) HYDROSTATIC CAMSHAFT PHASER

(71) Applicant: BORGWARNER, INC., Auburn Hills, MI (US)

(72) Inventors: Chad McCLoy, Cortland, NY (US); Douglas W. Perry, Interlaken, NY (US); Matthew N. Sherman, New City, NY (US)

(73) Assignee: BORGWARNER, INC., Auburn Hills, MI (US)

( * ) Notice: Subject to any disclaimer, the term of this patent is extended or adjusted under 35 U.S.C. 154(b) by 0 days.

(21) Appl. No.: 16/036,982

(22) Filed: Jul. 17, 2018

(65) Prior Publication Data

US 2020/0025044 A1 Jan. 23, 2020

(51) Int. Cl.
*F01L 1/344* (2006.01)

(52) U.S. Cl.
CPC ... *F01L 1/3442* (2013.01); *F01L 2001/34423* (2013.01); *F01L 2001/34459* (2013.01); *F01L 2001/34469* (2013.01)

(58) Field of Classification Search
CPC ..... F01L 1/3442; F01L 2001/34459; F01L 2001/34469; F01L 2001/34423; F01L 1/34; F01L 1/34409
USPC ..... 123/90.17
See application file for complete search history.

(56) References Cited

U.S. PATENT DOCUMENTS

| | | | | |
|---|---|---|---|---|
| 5,649,506 | A | 7/1997 | Melchior | |
| 6,814,037 | B1 | 11/2004 | Smith et al. | |
| 6,978,746 | B2 | 12/2005 | Kibler | |
| 8,155,862 | B2 | 4/2012 | Nishimoto et al. | |
| 9,562,446 | B2 | 2/2017 | Kawakami et al. | |
| 2005/0252465 | A1 | 11/2005 | Itou | |
| 2009/0107432 | A1 * | 4/2009 | McConville | F01L 1/267 123/90.17 |
| 2010/0132643 | A1 | 6/2010 | Jung | |

* cited by examiner

*Primary Examiner* — Jorge L Leon, Jr.
*Assistant Examiner* — Wesley G Harris
(74) *Attorney, Agent, or Firm* — Reising Ethington P.C.

(57) ABSTRACT

A hydrostatic camshaft phaser system includes a hydraulically-actuated camshaft phaser with a rotor; and a stator housing that receives the rotor and includes an advancing chamber and a retarding chamber defined at least partially by the vane; and a variable displacement pump, in fluid communication with the hydraulically-actuated camshaft phaser, comprising a first chamber in fluid communication with the advancing chamber and a second chamber in fluid communication with the retarding chamber; the first chamber receives fluid from a first non-continuous groove extending along a camshaft surface or a bearing surface and the second chamber receives fluid from a second non-continuous groove extending along the camshaft surface or the bearing surface during a first portion of camshaft rotation, and the first chamber receives fluid from the second non-continuous groove and the second chamber receives fluid from the first non-continuous groove during a second portion of camshaft rotation.

19 Claims, 8 Drawing Sheets

HYDROSTATIC CAMSHAFT PHASER

TECHNICAL FIELD

The present application relates to internal combustion engines (ICEs) and, more particularly, to variable camshaft timing (VCT) used with ICEs.

BACKGROUND

ICEs include one or more camshafts that open and close intake/exhaust valves and are rotationally driven by a crankshaft via an endless loop, such as a chain. The camshafts have shaped lobes that open and close valves as the camshafts are rotated. The opening and closing of the valves is precisely controlled based on the angular position of the camshaft(s) relative to the angular position of the crankshaft. In the past, the angular position of the crankshaft was fixed relative to the angular position of the camshaft(s). However, the ability to change the angular position of the camshaft relative to the angular position of the crankshaft such that ignition timing is advanced or retarded can help increase engine performance in a variety of ways, such as by improving engine smoothness as low-operating temperatures. The ability of change the angular position of the camshaft relative to the angular position of the crankshaft is often referred to as VCT.

VCT can be implemented in a variety of ways. For example, VCT can be implemented using camshaft phasers that are actuated electrically or hydraulically. With respect to hydraulically-actuated camshaft phasers, a stator receives a rotor having one or more vanes. The stator can include a camshaft sprocket that engages the endless loop and communicates rotational energy from a crankshaft sprocket that also engages the endless loop. The rotor can include one or more vanes and be received by chambers formed in the stator so that a radially-outward end of the vane abuts a radially-inward facing surface of the chamber to divide the stator into an advancing chamber section and a retarding chamber section. Supplying fluid, such as engine oil, to a first chamber while permitting fluid to exit a second chamber can move the rotor in one angular direction relative to the stator. The rotor can be moved in another angular direction if fluid is supplied to the second chamber and emptied from the first chamber. Various mechanisms exist for supplying this fluid. For example, an oil-pressure actuated (OPA) camshaft phaser can use fluid can be supplied to the chamber from an oil-pump included with the ICE that pressurizes fluid for supply to the camshaft phaser. The pressurized fluid can then be directed to the advancing chamber section or the retarding chamber section. However, it would be helpful to control the supply of fluid to the chambers without using a separate oil pump to pressurize the fluid.

SUMMARY

In one implementation, a hydrostatic camshaft phaser system includes a hydraulically-actuated camshaft phaser with a rotor having a vane extending radially outwardly from a hub; a stator housing that receives the rotor and includes an advancing chamber and a retarding chamber defined at least partially by the vane; and a variable displacement pump, in fluid communication with the hydraulically-actuated camshaft phaser, comprising a first chamber in fluid communication with the advancing chamber and a second chamber in fluid communication with the retarding chamber; the first chamber receives fluid from a first non-continuous groove extending along a camshaft surface or a bearing surface and the second chamber receives fluid from a second non-continuous groove extending along the camshaft surface or the bearing surface during a first portion of camshaft rotation, and the first chamber receives fluid from the second non-continuous groove and the second chamber receives fluid from the first non-continuous groove during a second portion of camshaft rotation.

In another implementation, a hydrostatic camshaft phaser system includes a hydraulically-actuated camshaft phaser with a stator housing that has a plurality of sprocket teeth extending radially outwardly from an outer surface; and a rotor, received within the stator housing, configured for connection to a camshaft and comprising at least one vane separating an advancing chamber and a retarding chamber within the stator housing; a variable displacement pump including: a first cylinder in fluid communication with the advancing chamber and in fluid communication with a first non-continuous groove in a bearing surface or camshaft surface during a first portion of camshaft rotation, wherein the first cylinder is in fluid communication with a second non-continuous groove in the bearing surface or the camshaft surface during a second portion of camshaft rotation; a second cylinder in fluid communication with the retarding chamber and in fluid communication with the second non-continuous groove during the first portion of camshaft rotation, wherein the second cylinder is in fluid communication with the first non-continuous groove for the second portion of camshaft rotation; and a first piston received by the first cylinder and a second piston received by the second cylinder, wherein the first piston is displaced relative to the first cylinder and the second piston is displaced relative to the second cylinder to change the phase of the camshaft.

DETAILED DESCRIPTION

Figure 1:
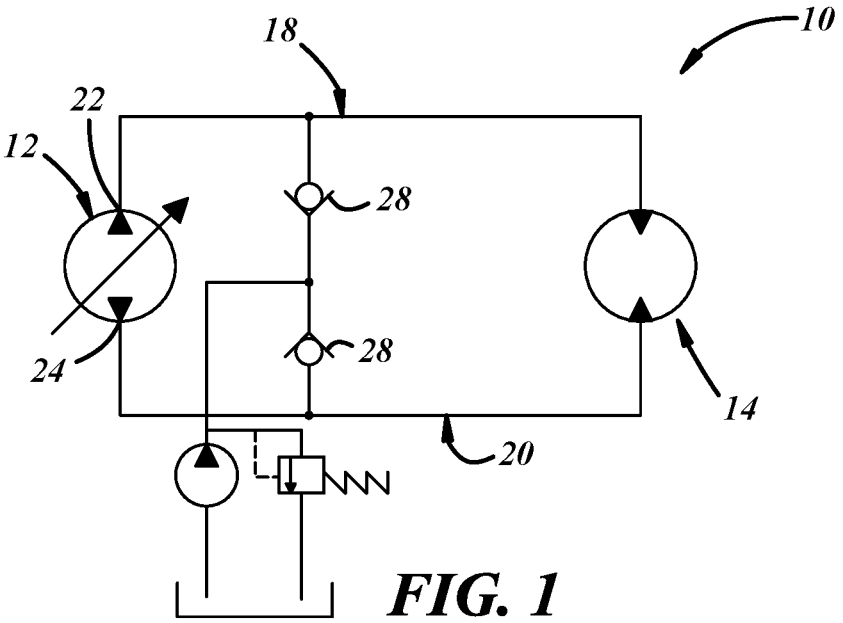
FIG. 1 is a schematic depicting an implementation of a hydrostatic camshaft phaser system.

A hydrostatic camshaft phaser system can use a variable displacement pump to adjust a camshaft between an advanced or retarded state relative to the crankshaft. The variable displacement pump is in fluid communication with a hydraulically-actuated camshaft phaser having a fixed displacement. An internal combustion engine (ICE) includes one or more camshafts that receive rotational input from a crankshaft as well as lubricating fluid from a source provided by the ICE. The rotational motion of the camshafts can pressurize and convey fluid through a plurality of fluid channels to the variable displacement pump, which directs the fluid to an advancing or retarding portion of the hydraulically-actuated camshaft phaser. The variable displacement pump can decrease the displacement in a first chamber relative to a second chamber to advance timing by adjusting the angular position of the camshaft(s) relative to the crankshaft in one angular direction. Decreasing displacement in the first chamber increases the quantity of fluid supplied to the advancing chamber of the hydraulically-actuated camshaft phaser causing the camshaft to change angular position relative to the crankshaft in an advancing direction. And the variable displacement pump can increase the displacement of the first chamber relative to the second chamber to retard timing by adjusting the angular position of the camshaft(s) relative to the crankshaft in another angular direction. Increasing displacement in the first chamber decreases the quantity of fluid supplied to the advancing chamber of the hydraulically-actuated camshaft phaser while increasing the quantity of fluid supplied to the retarding chamber of the phaser causing the camshaft to change angular position relative to the crankshaft in a retarding direction. The variable displacement pump can also maintain the angular position of the camshaft(s) relative to the crankshaft by maintaining the displacement of the first chamber relative to the second chamber.

The variable displacement pump and the hydraulically-actuated camshaft phaser can be coupled with the camshaft(s) so that the pump and the phaser maintain a fixed angular position relative to the angular position of the camshaft(s). In one implementation, the variable displacement pump can be implemented using a first piston received by a first chamber and a second piston received by a second chamber. A swash plate can remain fixed relative to the variable displacement pump so that the pump rotates with the camshaft relative to the plate. The swash plate can engage both the first piston and the second piston; to change the angular position of the camshaft relative to the crankshaft the swash plate can be articulated about a pivot to displace the first piston relative to the second piston thereby reducing the displacement of the first chamber or the second chamber. Increasing amounts of pivot toward the first chamber or the second chamber correspond to increasing amounts of angular displacement of the camshaft relative to the crankshaft in an advancing or retarding direction. Pivoting the swash plate closer to the first chamber of the variable displacement pump can advance or retard timing by changing the angular position of the camshaft relative to the crankshaft. When the swash plate is moved closer to the first chamber about the pivot, the first piston is moved linearly into the first chamber for the first half of the camshaft rotation and linearly out of the first chamber for the second half of the camshaft rotation. At the same time, the second piston is moved linearly out of the second chamber during the first half of the camshaft rotation and linearly into the second chamber during the second half of camshaft rotation. The motion of the piston in one linear direction during a first half of camshaft rotation and another linear direction during a second half of camshaft rotation can be coordinated with fluid passageways selectively formed in the ICE.

For example, two sets of fluid pathways can be formed in the camshaft, the bearings, or both; a first set of fluid pathways permits fluid flow through approximately 0-180 degrees of camshaft rotation but prevents fluid flow through approximately 181-360 degrees of camshaft rotation. A second set of fluid pathways prevents fluid flow through approximately 0-180 degrees of camshaft rotation and permits fluid to through approximately 181-360 degrees of camshaft rotation. The first set of fluid pathways can be formed so that they extend along a portion of the circumferential surface of the bearing and the second set of fluid pathways can be formed so that they extend along another portion of the circumferential surface of the bearing. The first set of fluid pathways can be in fluid communication with the advancing chamber of the camshaft phaser and the second set of fluid pathways can be in fluid communication with the retarding chamber of the camshaft phaser. The fluid pathways can be angularly positioned about the camshaft or journal bearing so that they push fluid into one chamber of the hydraulically-actuated camshaft phaser and pull fluid from the other chamber of the phaser when the swash plate is moved closer to the first chamber or the second chamber. A fluid pump can supply pressurized oil to the hydrostatic camshaft phaser system to ensure that a sufficient amount of fluid is supplied to the system.

Turning to FIG. 1, a general schematic depicting an implementation of a hydrostatic camshaft phaser system 10 is shown. The system 10 includes a variable displacement pump 12, a hydraulically-actuated camshaft phaser 14, a fluid supply pump, a first set of fluid pathways 18, and a second set of fluid pathways 20. The variable displacement pump 12 can adjust the hydraulically-actuated camshaft phaser 14 between an advanced position and a retarded position by changing the fluid displacement in a first chamber 22 or a second chamber 24. When the fluid displacement in the first chamber 22 is reduced, fluid can flow to the first set of fluid pathways 18 from the second set of fluid pathways 20 and the hydraulically-actuated camshaft phaser 14 can advance the timing of the camshaft relative to the crankshaft. And when the fluid displacement in the second chamber 24 is reduced, fluid can flow to the second set of fluid pathways 20 from the first set of fluid pathways 18 and the hydraulically-actuated camshaft phaser 14 can retard the timing of the camshaft relative to the crankshaft. A fluid supply pump 26 provided by an ICE that includes the camshaft(s) and crankshaft can provide a supply of fluid, such as engine oil, to the system 10. One or more check valves 28 can prevent the flow of fluid toward the fluid supply pump 26.

Figure 3:
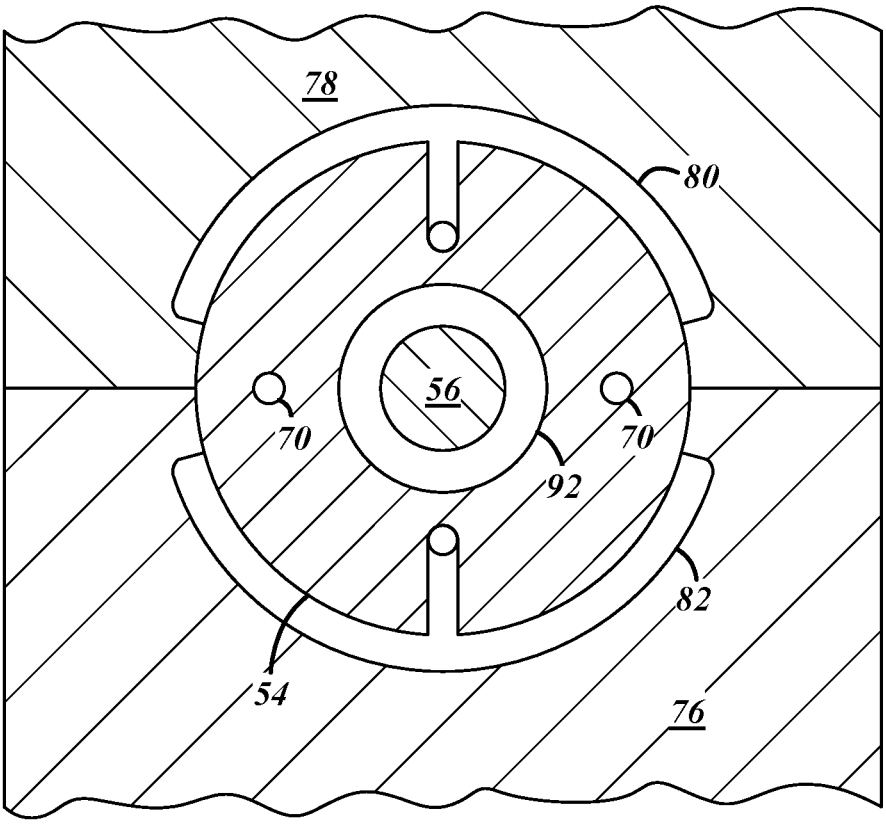
FIG. 3 is a sectional view of a camshaft used in an implementation of a hydrostatic camshaft phaser system.
Figure 2:
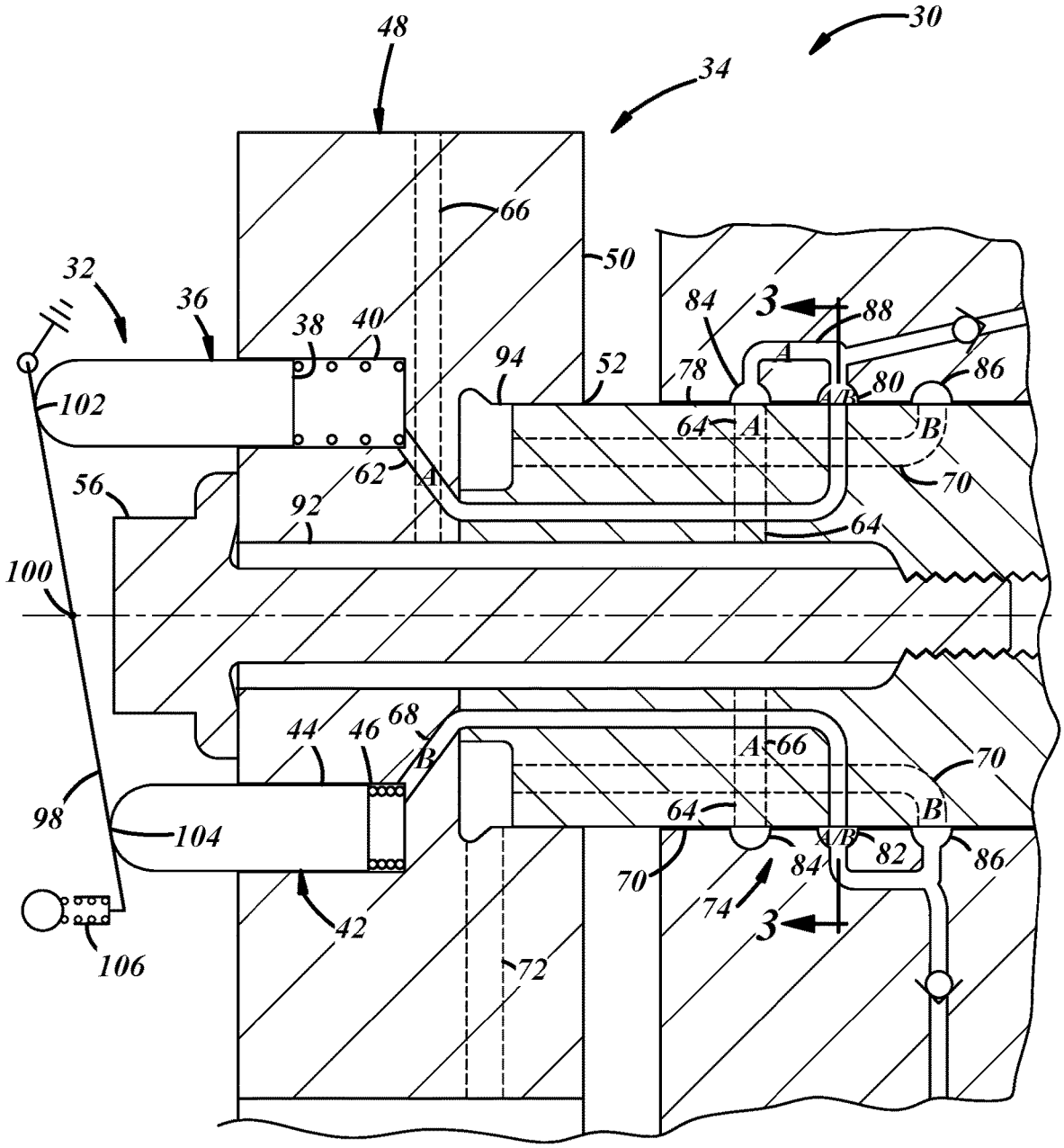
FIG. 2 is a cross-sectional view depicting an implementation of a hydrostatic camshaft phaser system.

FIGS. 2-3 depict an implementation of a hydrostatic camshaft phaser system 30. The system includes a variable displacement pump 32 and a hydraulically-actuated camshaft phaser 34. The variable displacement pump 32 in this implementation includes a first chamber 36 implemented as a first piston 38 received by a first cylinder 40 and a second chamber 42 implemented as a second piston 44 received by a second cylinder 46. However, it should be appreciated that other implementations of variable displacement pumps are possible. For example, the variable displacement pump could also be implemented using a variable displacement vane pump, such as a gerotor or other similar type of hydraulic pump. A portion of the hydraulically-actuated camshaft phaser 14 is shown. Hydraulically-actuated camshaft phasers typically include a rotor 48 having a plurality of vanes 50 that extend radially outwardly from a hub 52 and a stator housing (not shown) that receives the rotor 48. An example of a hydraulically-actuated camshaft phaser is described in U.S. application Ser. No. 12/921,425 the contents of which are hereby incorporated by reference. The rotor 48 can be mechanically attached to a camshaft 54 by a fastener 56, such as a bolt, and the camshaft 54 can be installed in the head of the ICE. The camshaft 54 and the motor 48 includes a portion of the first set of fluid pathways and a portion of the second set of fluid pathways. The first set of fluid pathways include a first rotor pathway 62 in the rotor 48 and the camshaft 54 and first camshaft pathways 64 in the camshaft 54 that communicate fluid between the first cylinder 40 and the first chamber 36 of the phaser 14 using a first chamber pathway 66. The second set of fluid pathways include a second rotor pathway 68 in the rotor 48 and the camshaft 54 and second camshaft pathways 70 in the camshaft 54 that communicate fluid between the second cylinder 46 and the second chamber 42 using a second chamber pathway 72. The first/second rotor pathways 62,68 fluidly communicate with the first cylinder 40 or the second cylinder 46 depending on the angular position of the camshaft 54. This will be discussed in more detail below.

An external surface of the camshafts 54 where the first camshaft pathways 64 and the second camshaft pathways 70 exit can be axially aligned with a bearing surface 74 of the head used in the ICE. The bearing surface 74 can closely conform to the outer surface of the camshaft 54 and include one or more non-continuous circumferential grooves and one or more circumferential grooves formed in the head 70 and the bearing cap 78. In addition to or instead of the grooves formed in the bearing surface 74, the non-continuous and continuous grooves could be formed in an outer surface of the camshaft 54. The non-continuous circumferential grooves can extend circumferentially along an angular portion of the radially-inwardly facing bearing surface 74 collectively formed by the head 70 and the bearing cap 73. In this implementation, the bearing surface 74 includes a first non-continuous groove 80 and a second non-continuous groove 82 that each faces radially-inwardly toward an outer surface of the camshaft 54. The first non-continuous groove 80 can extend along an arc <180 degrees along the bearing surface 74 and the second non-continuous groove 82 can also extend along an arc <180 degrees along the bearing surface 74. In this implementation, the first non-continuous groove 80 can be formed in the head 70 and the second non-continuous groove 82 can be formed in the bearing cap 78. During half of the radius of camshaft rotation the first non-continuous groove 86 is in fluid communication with the first rotor pathway 62, the first camshaft pathway 64 and the first chamber pathway 66 and the second non-continuous groove 82 is in fluid communication with the second rotor pathway 68, the second camshaft pathway 70, and the second chamber pathway 72. During the other half of the radius of camshaft rotation the first non-continuous groove is in fluid communication with the second rotor pathway 68, the second camshaft pathway 70, and the second chamber pathway 72 while the second non-continuous groove 82 is in fluid communication with the first rotor pathway 62, the first camshaft pathway 64, and the first chamber pathway 66.

One or more continuous grooves can also be formed in the bearing surface 74. The continuous groove(s) can face radially-inwardly toward the camshaft surface and communicate fluid from the fluid supply pump 26 to the advancing chamber and the retarding chamber of the hydraulically-actuated camshaft phaser 14. In this implementation, the bearing surface 74 includes a first continuous groove 84 and a second continuous groove 86. An advancing fluid link 88 communicates fluid between the first continuous groove 84 and the first non-continuous groove 80 and a retarding fluid link 90 communicates fluid between second continuous groove 86 and the second non-continuous groove 82. The first camshaft pathway 64 can extend from an external surface of the camshaft 54 to an advancing supply chamber 92 formed within the camshaft 54 and the rotor 48. The first camshaft pathway 64 can be positioned so that its location along the external surface of the camshaft 54 is axially aligned with the first continuous groove 84; the first camshaft pathway 64 can communicate fluid provided by the fluid supply pump 26 to the advancing supply chamber 92. A first chamber pathway 66 can be formed in the rotor 48 and extend radially-outwardly from the advancing supply chamber 92 to the advancing chamber of the camshaft phaser 14. A second camshaft pathway 70 can extend from an external surface of the camshaft to a retarding supply chamber 94 formed within the camshaft 54 and the rotor 48. The second camshaft pathway 70 can be positioned so that its location along the external surface of the camshaft 54 is axially aligned with the second continuous groove 86 so that the second camshaft pathway 70 can communicate fluid provided by the fluid supply pump 26 to the retarding supply chamber 94. A common fluid supply line 96 can flow fluid from the fluid supply pump 26 to the first continuous groove 84 and the second continuous groove 86 that can communicate the fluid through the first camshaft pathways 64 and the second camshaft pathway 70 to the advancing supply chamber 92 and retarding supply chamber 94, and ultimately to the advancing chamber and retarding chamber of the camshaft phaser 14.

When the hydraulically-actuated camshaft phaser 14 is assembled and the rotor 48 is received in the stator/housing, fluid can be selectively directed into the advancing chamber of the phaser 14 and against one side of the vane(s) to advance timing of the camshaft 54 relative to the crankshaft or into the retarding chamber against another side of the vane(s) 50 to retard timing of the camshaft 54 relative to the crankshaft. The selective flow of fluid into an advancing chamber or a retarding chamber of the hydraulically-actuated camshaft phaser 14 can change the angular position of the rotor 48 relative to the stator/housing and thereby change the angular position of the camshaft 54 relative to the crankshaft. In this implementation, the rotor 48 includes the first cylinder 40 and the second cylinder 46 that receive the first piston 38 and the second piston 44, respectively. A swash plate 98 can be mounted about a pivot 100 located between the first piston 38 and the second piston 44. The swash plate 98 can remain fixed about the pivot 100 and in contact with a first piston end 102 and a second piston end 104 as the camshaft 54 and the hydraulically-actuated camshaft phaser 14 rotate during operation of the ICE. An adjusting member 106 can engage a portion of the swash plate 98 to maintain or change its position about the pivot 100. Moving a portion of the swash plate 98 toward the first cylinder 40 about the pivot 100 can move the camshaft 54 in one angular direction with respect to the crankshaft while moving another portion of the swash plate 98 about the pivot 100 toward the second cylinder 46 can move the camshaft 54 in another angular direction with respect to the crankshaft. The adjusting member 106 can be implemented using a ball screw rotated by an electric motors or an electric solenoid linearly moving a control arm. It is also possible to use a hydraulic valve that controls and adjustment arm for tilting the swash plate 98. A spring can be used to bias the swash plate in a neutral position such that the first piston 38 and the second piston 44 displace relatively similar amounts of fluid and the angular position of the camshaft 54 relative to the angular position of the crankshaft is neither advanced nor retarded.

As the variable displacement pump 12 rotates, the swash plate 98 can maintain contact with the first piston end 102 and the second piston end 104; the first piston 38 and the second piston 44 can be held in a position relative to the first cylinder 40 and the second cylinder 46, respectively, by the swash plate 48 to maintain the angular position of the camshaft 54 relative to the crankshaft. However, as is shown in FIG. 2, the adjusting member 106 can move the swash plate 98 so that the first piston 38 is moved axially relative to the first cylinder 40 and inwardly toward the rotor 48 while the second piston 44 is moved axially relative to the second cylinder 46 and away from the rotor 48. In this position, fluid is displaced from the first cylinder 40 and directed into the advancing supply chamber 92 and, ultimately, to two advancing chambers of the camshaft phaser 14 so that less fluid exists in the first cylinder 40 relative to the amount of fluid that exists in the second cylinder 46. In contrast, the adjusting member 106 can move the swash plate 98 so that the second piston 44 is moved axially relative to the second cylinder 46 and inwardly toward the rotor 48 while the first piston 38 is moved axially relative to the first cylinder 40 and away from the rotor 48. In this position, fluid is displaced from the second cylinder 46 and directed into the retarding supply chamber 94 and ultimately, to the retarding chamber of the camshaft phaser 14 so that less fluid exists in the second cylinder 46 relative to the amount of fluid that exists in the first cylinder 40.

Figure 4:
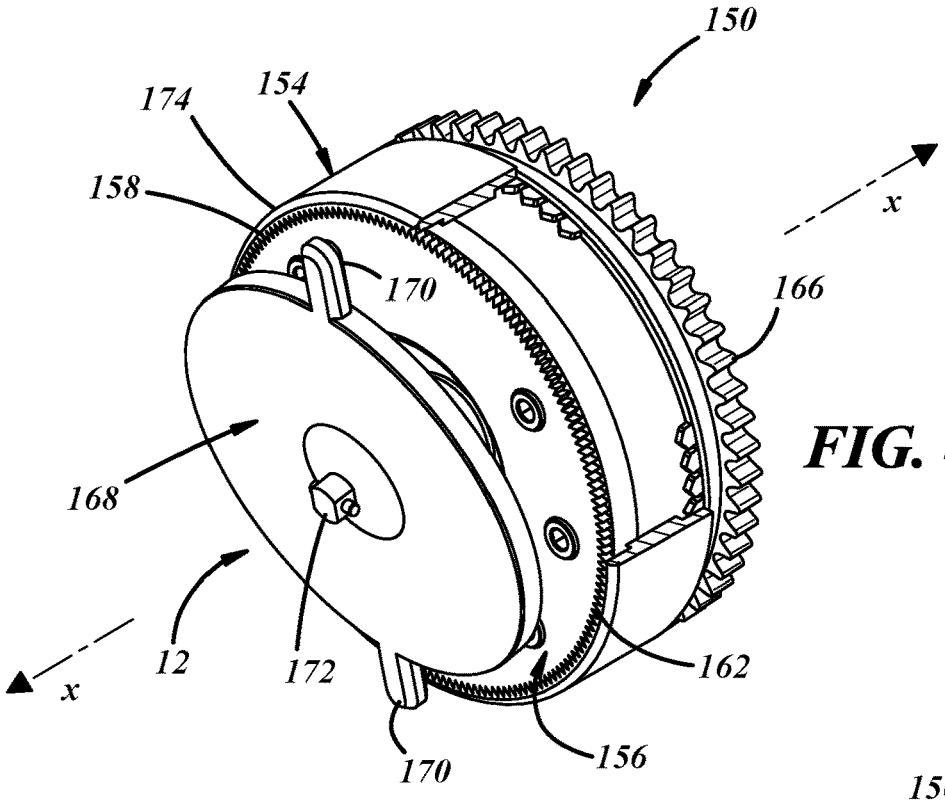
FIG. 4 is a perspective view depicting an implementation of a hydrostatic camshaft phaser system.
Figure 5:
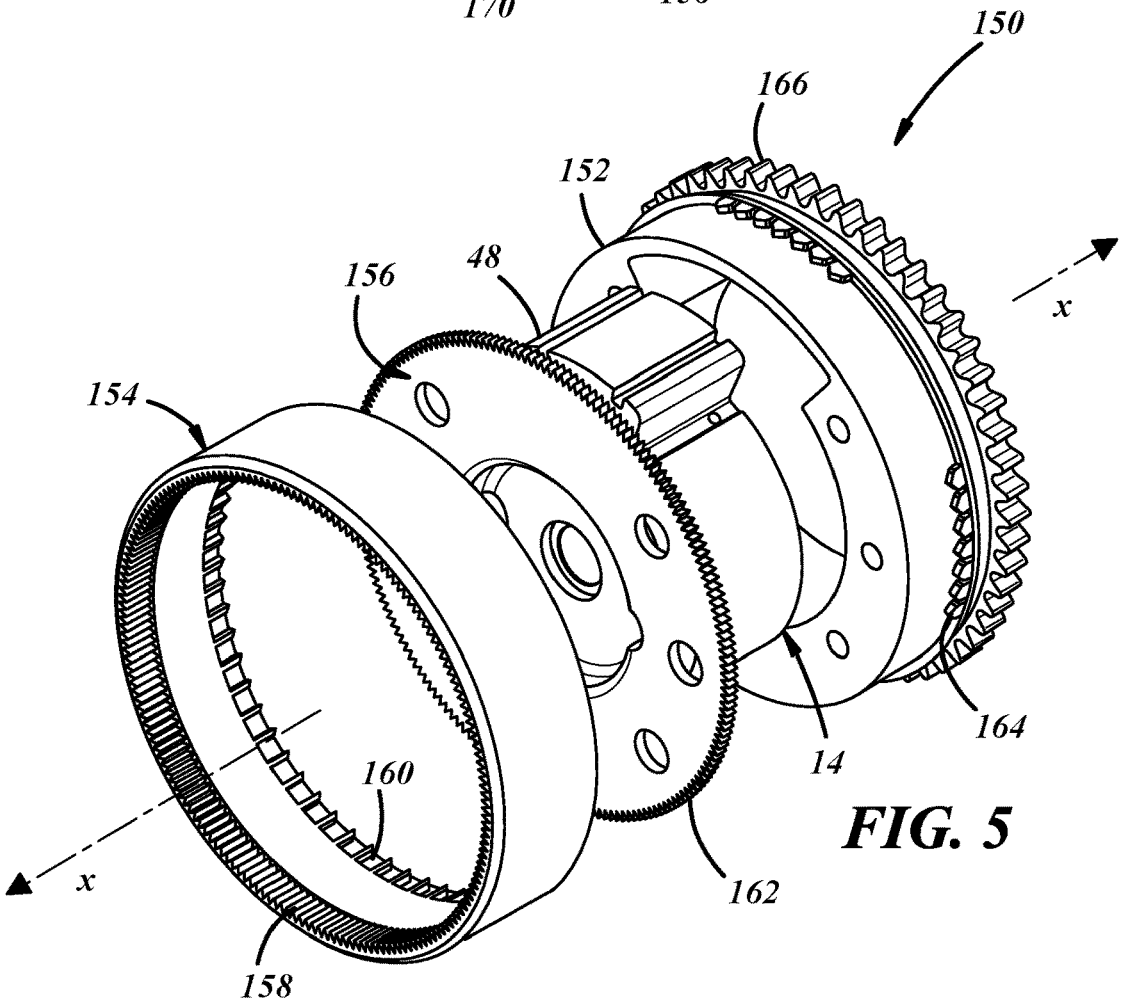
FIG. 5 is a perspective exploded view depicting a portion of an implementation of a hydrostatic camshaft phaser system.

A number of other implementations of the hydrostatic camshaft phaser system are possible. Turning to FIGS. 4-5, an implementation of a hydrostatic camshaft phaser system 150 is shown. The system 150 includes a hydraulically-actuated camshaft phaser 14 and a variable displacement pump 12 similar to what is described above with respect to FIGS. 2-3. The camshaft phaser 14 includes a rotor 48 and a stator housing 152. The rotor 48 is coupled with the camshaft (not shown) and the stator housing 152 receives rotational input from a crankshaft. The variable displacement pump 12 is at least partially included in the rotor 48 and comprises a first piston and a second piston (not shown) received by a first cylinder and a second cylinder (not shown), respectively. A locking sleeve 154 can be moved axially along an axis of camshaft rotation (X) to engage both a locking plate 156 that is coupled with the rotor 48 and the stator housing 152 when the hydraulically-actuated camshaft phaser 14 is adjusted so that the angular position of the camshaft is advanced or retarded relative to the angular position of the crankshaft. The locking sleeve 154 can be annularly shaped and have rotor teeth 158 that include a first plurality of radially-inwardly facing gear teeth and stator teeth 160 that include a second plurality of radially-inwardly facing gear teeth. The locking plate 156, coupled with the rotor 48, can include radially-outwardly extending rotor locking teeth 112 that engage the rotor teeth 158 of the locking sleeve 154. The stator housing 152 can include stator locking teeth 164 having a plurality of gear teeth that engage the stator teeth 160 of the locking sleeve 154 when the locking sleeve 154 is moved axially in response to advancing or retarding timing. In one implementation, the stator teeth 160 define a plurality of planar slots. The stator locking teeth 164 on the stator housing 152 can be oriented so that the top lands are perpendicular to the axis of camshaft rotation (X) and engage the teeth 164 in a way that the top lands fit within the planar slots. The stator teeth 160 and the stator locking teeth 164 could be implemented using a crown gear. The stator housing 152 also incorporates radially-outwardly facing gear teeth that form a camshaft sprocket 166, which can engage an endless loop also linked to a crankshaft sprocket (not shown) providing rotational motion to the camshaft. A swash plate 168 can include a plurality of protrusions 170 that extend outwardly from a pivot point 172. The protrusions 170 can engage an edge 174 of the locking sleeve 154 and as the swash plate 168 is tilted or angled about the pivot point 172 the protrusions move the locking sleeve 154 axially relative to the axis of camshaft rotation (X).

Figure 6:
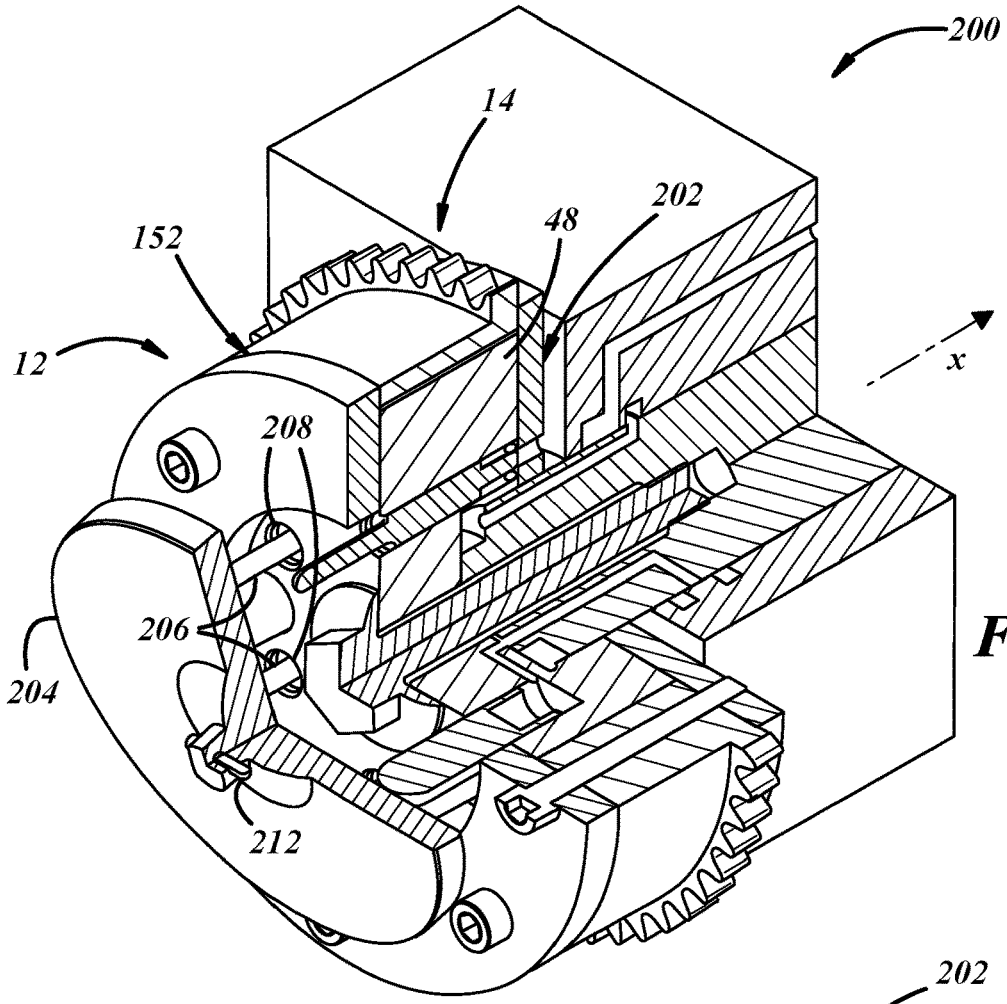
FIG. 6 is a perspective view depicting an implementation of a hydrostatic camshaft phaser system.
Figure 7:
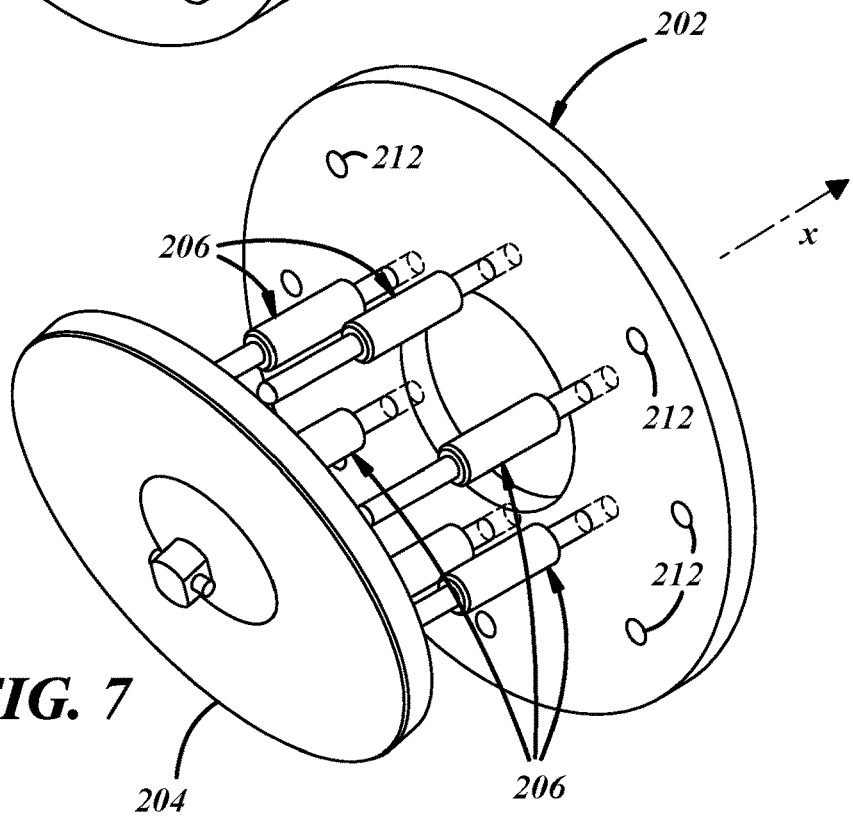
FIG. 7 is a perspective view depicting a portion of an implementation of a hydrostatic camshaft phaser system.
Figure 8:
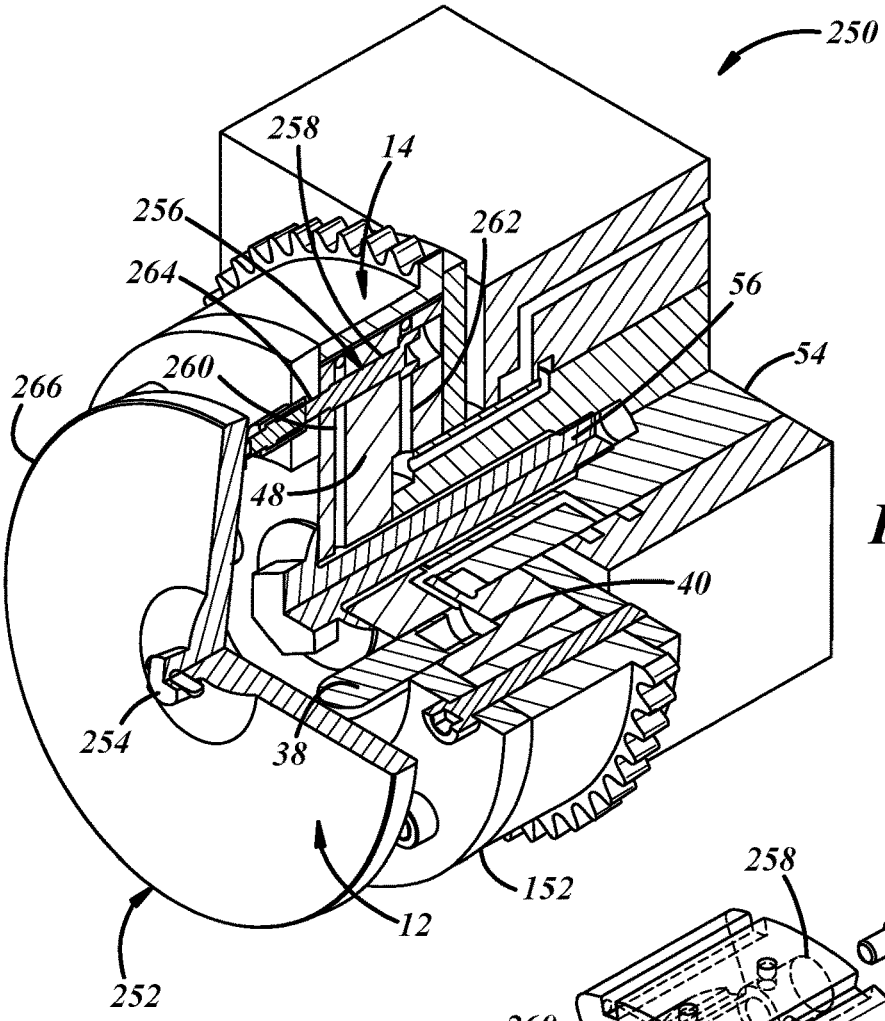
FIG. 8 is a perspective cross-sectional view depicting an implementation of a hydrostatic camshaft phaser system.
Figure 9:
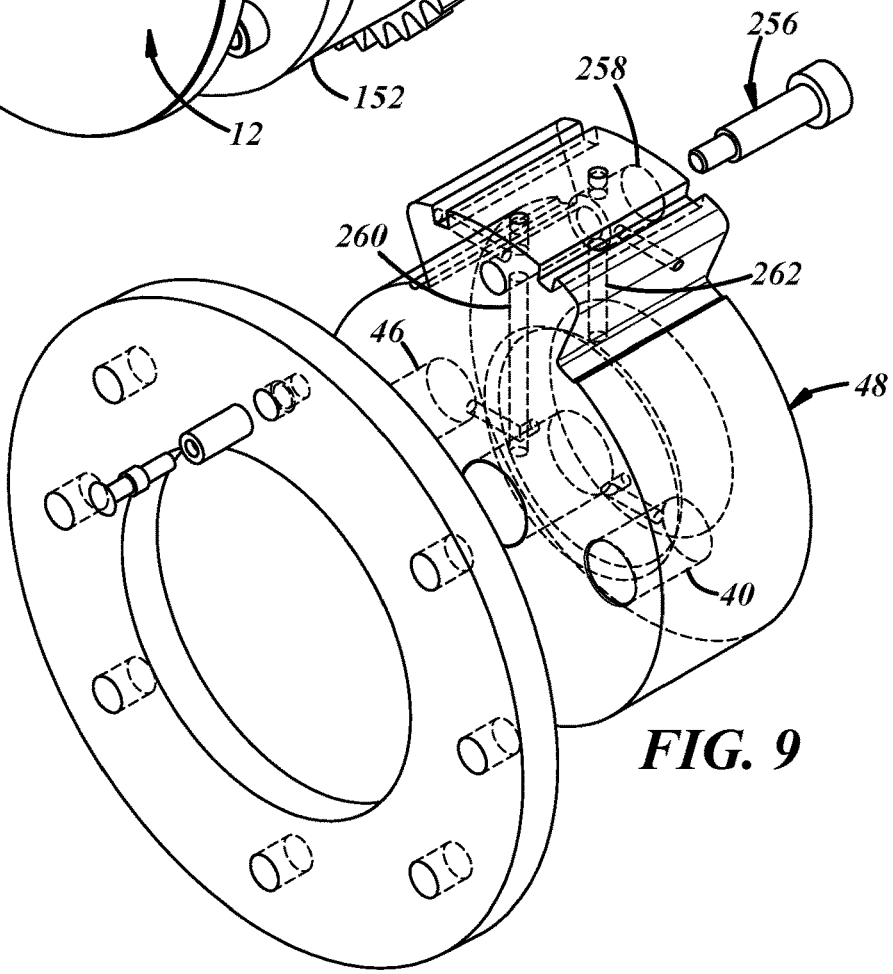
FIG. 9 is a perspective exploded view depicting a portion of an implementation of a hydrostatic camshaft phaser system.

In FIGS. 6-7, another implementation of the hydrostatic camshaft system 200 is shown. The system 200 includes a hydraulically-actuated camshaft phaser 14 and a variable displacement pump 12. The camshaft phaser 14 includes a rotor 48 and a stator housing 152. The variable displacement pump 12 is at least partially included in the rotor 48 and comprises a first piston and a second piston received by a first cylinder and a second cylinder, respectively (not shown). The system 200 includes a stator plate 202 that is coupled with the stator housing 152 and used to lock the rotor 48 in a fixed angular position relative to the stator housing 152. A swash plate 204 can engage or be linked with a plurality of locking pistons 206 that extend substantially perpendicular to the stator plate 202. The stator plate 202 can be coupled to a side of the stator housing 152 so that the swash plate 204 and the stator plate 202 are positioned on opposite sides of the rotor 48. The locking pistons 206 can extend parallel to the axis of camshaft rotation (X) from the swash plate 204 through rotor apertures 208 in the rotor 48 that extend from one side of the rotor 48 to another side of the rotor 48. When the swash plate 202 is articulated in a neutral position so that the angular position of the camshaft relative to the crankshaft is neither advanced or retarded, the plurality of locking pistons 206 extend into rotor apertures 208 but not beyond those apertures 208 so that the locking pistons 206 do not engage the stator plate 202 at locking receivers 212 formed in the stator plate 202. When the swash plate 204 is angled or tilted about a pivot 212 to change the angular position of the camshaft relative to the crankshaft as has been described above, either advancing or retarding timing, at least one of the locking pistons 206 moves axially toward the stator plate 202 extending outwardly from and beyond the rotor aperture 208 and engaging at least one of a plurality of locking receivers 210. Locking receivers 210 can be slots or openings in the stator plate 202 that can engage a locking piston 206 to prevent relative angular movement between the rotor 48 and the stator housing 152. The swash plate 204 remains rotationally fixed while the rotor 48 and stator plate 202 rotate along with the camshaft during ICE operation. As the rotor 48 and stator plate 202 rotate, different pistons from the plurality of locking pistons 206 axially extend toward locking receivers 210 so that a plurality of locking pistons 206 engage and release a plurality of locking receivers 210 as the camshaft rotates through one full rotation extending 2 $\pi$ or 360 degrees.

Turning to FIGS. 8-12, another implementation of the hydrostatic camshaft system 250 is shown. The system 250 includes a hydraulically-actuated camshaft phaser 14 and a variable displacement pump 12. The camshaft phaser 14 includes a rotor 48 and a stator housing 152. The variable displacement pump 12 is at least partially included in the rotor 48 and comprises the first piston 38 and the second piston (not shown) received by the first cylinder 40 and a second cylinder 46, respectively. The first cylinder 40 is in fluid communication with the advancing chamber of the camshaft phaser 14 and the second cylinder 46 is in fluid communication with the retarding chamber of the camshaft phaser 14. A swash plate 252 is mounted about a pivot 254 and engages the first piston 38 and the second piston tilting about the pivot 254 to change the angular position of the camshaft relative to the crankshaft. The rotor 48 includes a locking pin 256 located within a rotor aperture 258 that extends from one end of the rotor 48 to another end of the rotor 48. The rotor aperture 258 can be cylindrically shaped to receive the locking pin 256 so that the surface of the rotor aperture 258 closely conforms to an outer surface of the locking pin 258. In addition, the rotor 48 includes an advancing fluid lock pathway 260 that communicates fluid from the advancing chamber of the camshaft phaser 14 to the rotor aperture 258 and a retarding fluid lock pathway 262 that communicates fluid from the retarding chamber of the camshaft phaser 14 to the rotor aperture 258.

The locking pin 256 can slide axially within the rotor aperture 258 to engage a locking feature 264, such as a bore or slot, formed in the stator housing 152. The locking pin 256 can be biased into engagement with the locking feature 264 when the hydraulically-actuated camshaft phaser 14 is neither advancing or retarding camshaft timing such as could occur when a swash plate 266 is not contacting either the first piston 38 or the second piston or the first piston 38 and second piston are positioned to provide equal amounts of fluid in the advancing chamber and the retarding chamber. The locking pin 256 can include an advancing shoulder 268 and a retarding shoulder 270 that is axially spaced from the advancing shoulder 208. The advancing shoulder 268 and the retarding shoulder 270 can each be formed on an outer surface of the locking pin 256 and have substantially perpendicular surfaces.

Figure 10:
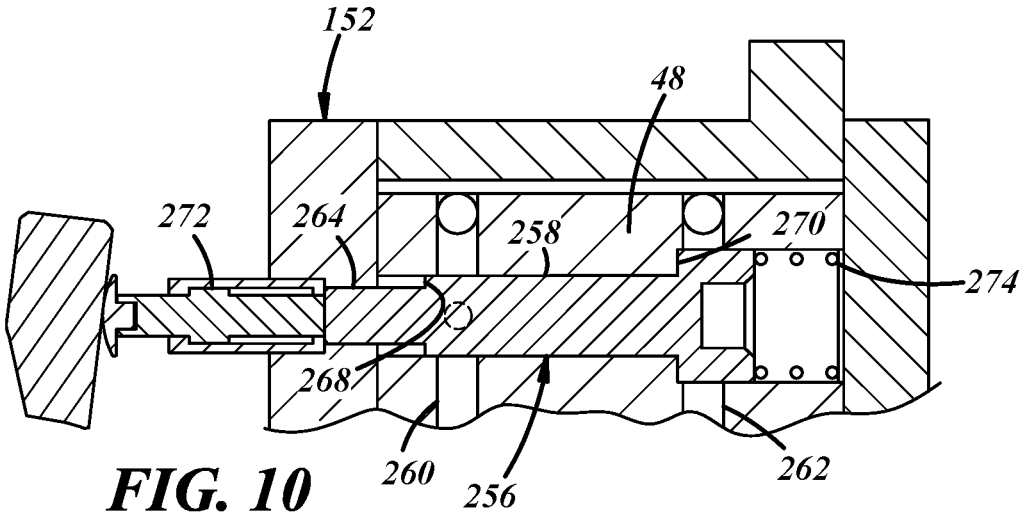
FIG. 10 is a cross-sectional view depicting a portion of an implementation of a hydrostatic camshaft phaser system.
Figure 11:
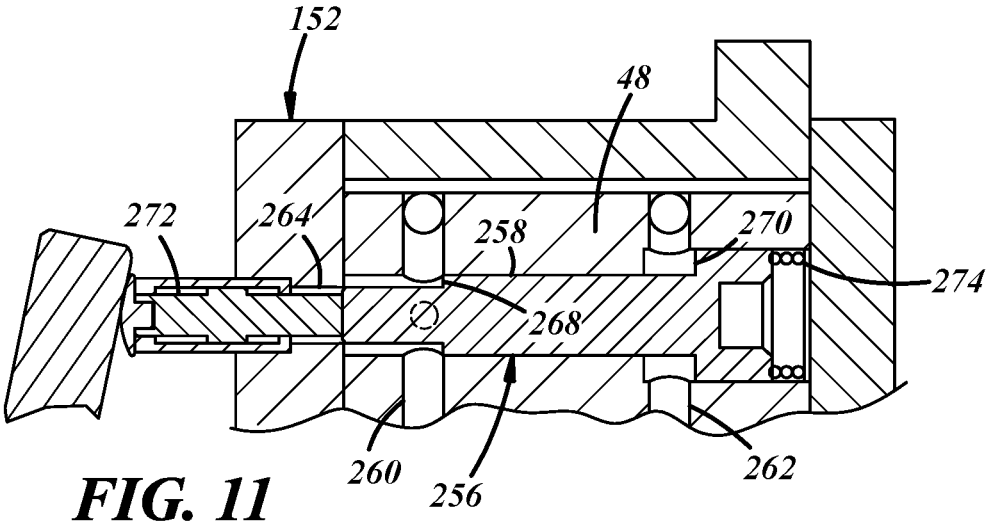
FIG. 11 is a cross-sectional view depicting a portion of an implementation of a hydrostatic camshaft phaser system.
Figure 12:
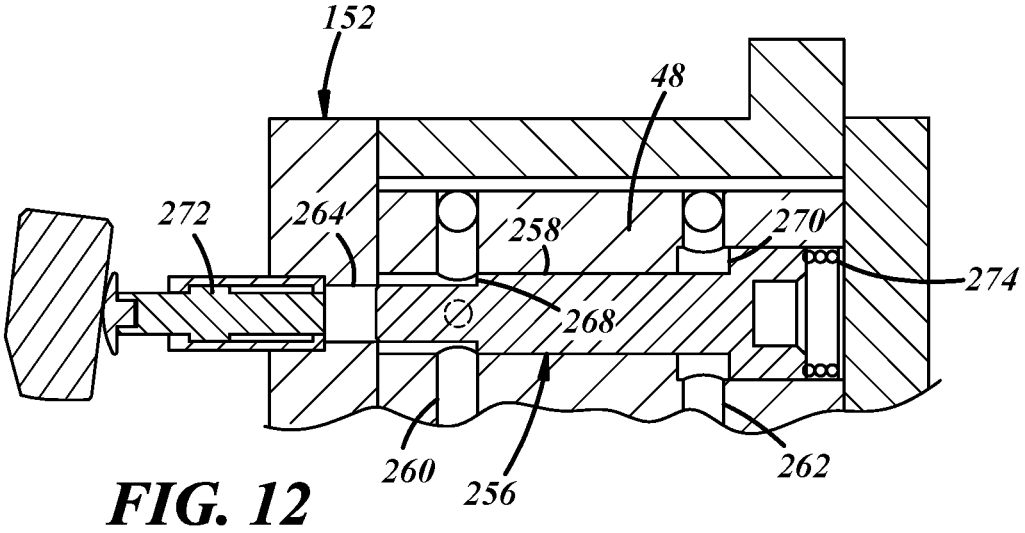
FIG. 12 is a cross-sectional view depicting a portion of an implementation of a hydrostatic camshaft phaser system.
Figure 13:
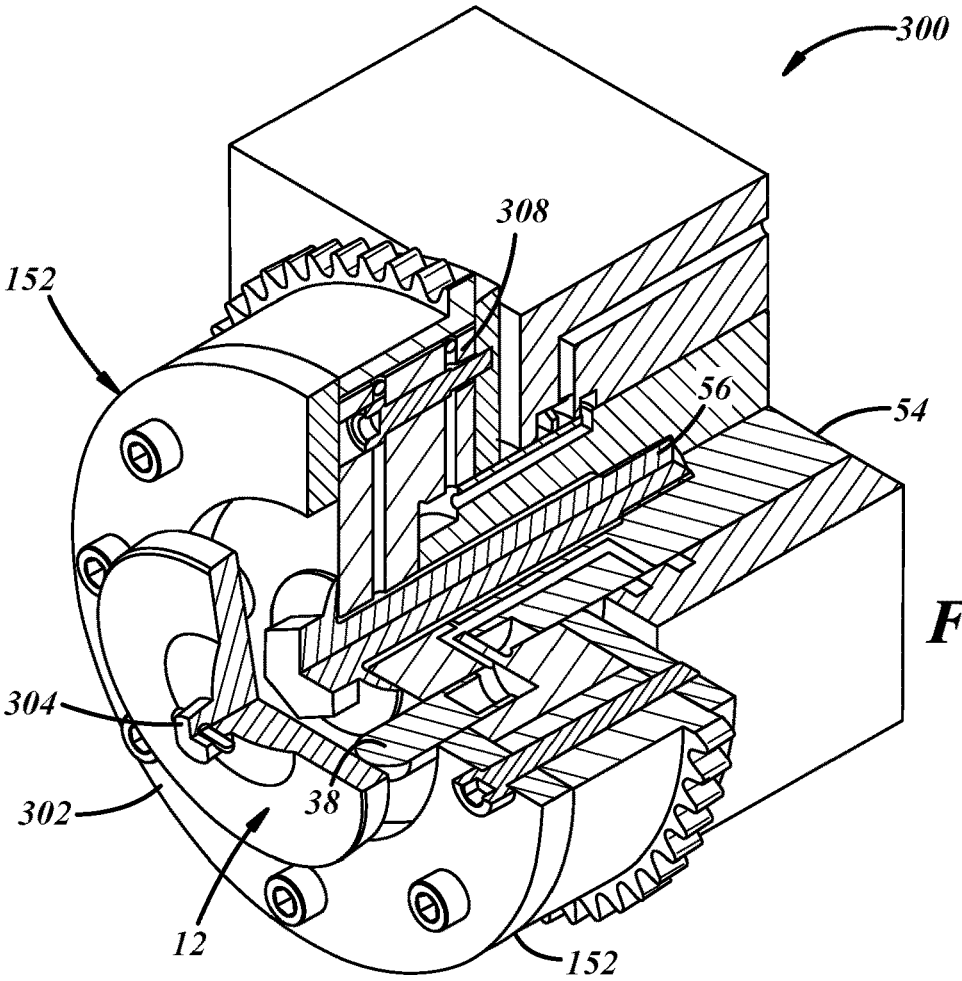
FIG. 13 is a perspective cross-sectional view depicting an implementation of a hydrostatic camshaft phaser system.
Figure 14:
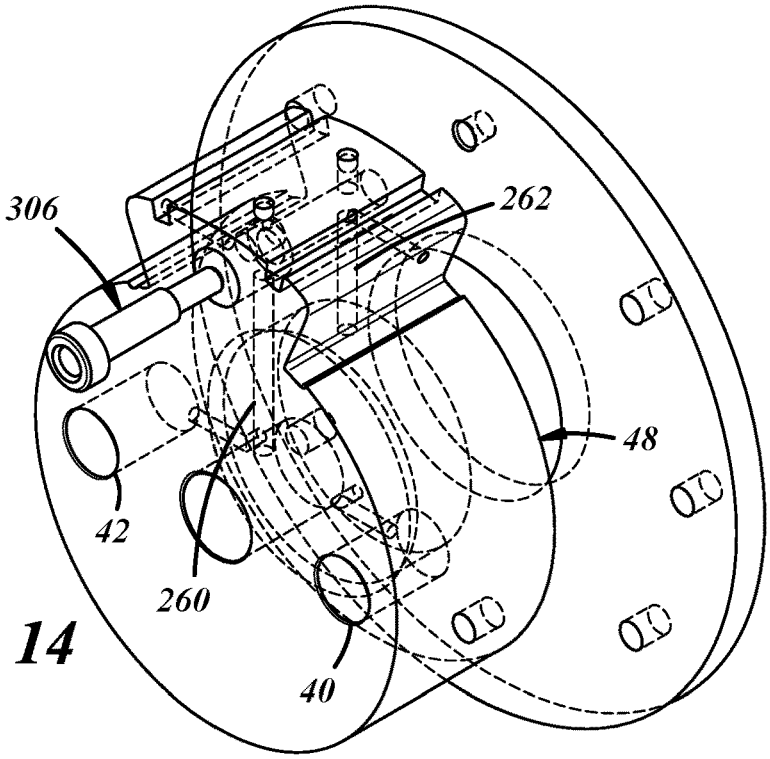
FIG. 14 is a perspective exploded view depicting a portion of an implementation of a hydrostatic camshaft phaser system.
Figure 15:
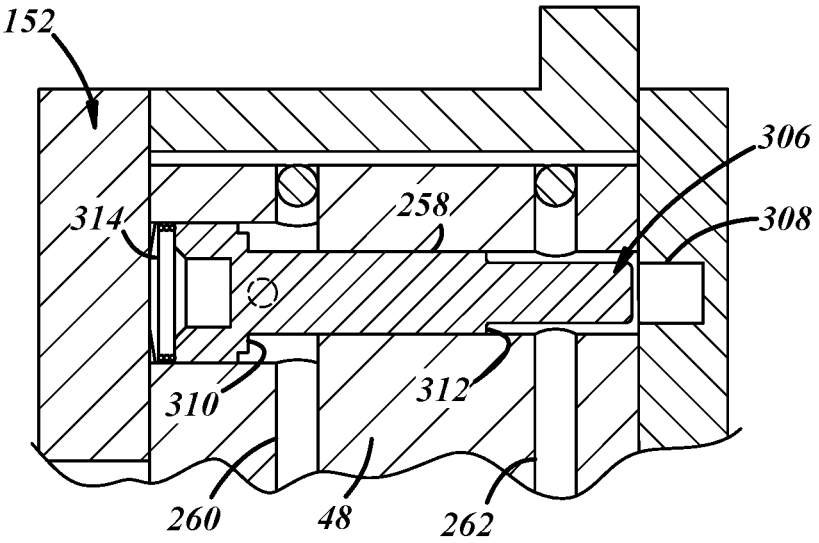
FIG. 15 is a cross-sectional view depicting a portion of an implementation of a hydrostatic camshaft phaser system.
Figure 16:
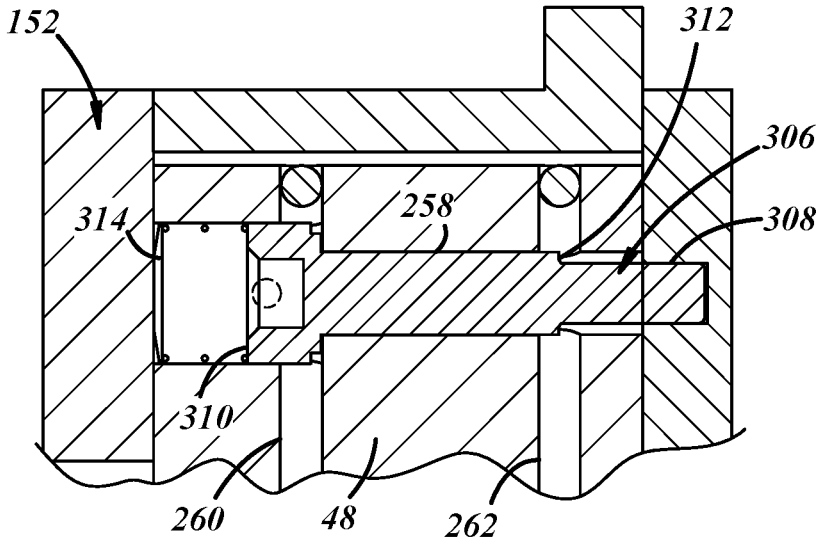
FIG. 16 is a cross-sectional view depicting a portion of an implementation of a hydrostatic camshaft phaser system.

A plunger 272 can be aligned substantially axially or coaxially with the locking pin 256 within the locking feature 264 and included with the stator housing 152. The plunger 272 can be a stud that engages an end of the locking pin 256 within the locking feature 264 and extends outside of the stator housing 152 so that the plunger 272 may be engaged and axially moved by the swash plate 266 when the hydraulically-actuated camshaft phaser 14 is controlled to advance or retard camshaft timing. The swash plate 266 can be pivoted to be parallel with an outer surface of the stator housing 152 such that the angular position of the camshaft is neither advanced nor retarded relative to the crankshaft. Articulated in this way, the swash plate may not contact the plunger 272 and the locking pin 256 can be biased into engagement with the locking feature 264 by a biasing member 274 such as a spring as is shown in FIG. 10. The outer surface of the locking pin 256 prevents the flow of fluid from the advancing fluid lock pathway 260 and the retarding fluid lock pathway 262 into the rotor aperture 258. As the swash plate 252 is tilted about the pivot 254 to change the angular position of the camshaft relative to the crankshaft, the swash plate 252 can engage the plunger 272 and axially move the plunger 272 thereby forcing the locking pin 256 out of the locking feature 264. This is shown in FIG. 11. As the locking pin 256 is axially displaced in response to the movement of the plunger 272, the pin 256 disengages with the locking feature 264. In addition, the advancing shoulder 268 and the retarding shoulder 270 can each move from one position along the rotor aperture 258 to another position thereby permitting the flow of fluid from the advancing chamber or the retarding chamber, respectively, to the rotor aperture 258. As the swash plate 266 is tilted about the pivot 254 to change the timing of the camshaft, either the advancing chamber or the retarding chamber of the camshaft phaser receives a greater volume and pressure of fluid, which is then communicated with the advancing shoulder 268 or the retarding shoulder 270 to oppose the biasing action of the biasing member 274 and maintain the axial position of the locking pin 256 in a unlocked state such that the locking pin 256 is not engaged with the locking feature 264 while timing is advanced or retarded. As the swash plate 266 is returned to a position that neither advances or retards the relative camshaft position, fluid pressure and flow from the advancing or retarding chambers may maintain the locking pin 256 in an axially displaced position as shown in FIG. 12 until the fluid pressure subsides and the biasing member 274 overcomes the reduced fluid pressure supplied by either the advancing fluid lock pathway 260 or the retarding fluid lock pathway 262. The locking pin 256 can then be urged into engagement with the locking feature 264.

Yet another implementation of a hydrostatic camshaft system 300 is shown in FIGS. 13-16. The system 300 includes a hydraulically-actuated camshaft phaser 14 and a variable displacement pump 12. The camshaft phaser 14 includes a rotor 48 and a stator housing 152. The variable displacement pump 12 is at least partially included in the rotor 48 and comprises a first piston 38 and a second piston (not shown) received by a first cylinder 40 and a second cylinder 42, respectively. The first cylinder 40 is in fluid communication with the advancing chamber of the camshaft phaser 14 and the second cylinder 42 is in fluid communication with the retarding chamber of the camshaft phaser 14. A swash plate 302 is mounted about a pivot 304 and engages the first piston 38 and the second piston tilting about the pivot 304 to change the angular position of the camshaft relative to the crankshaft. The rotor 48 includes a locking pin 306 located within a rotor aperture 258 that extends from one end of the rotor 48 to another end of the rotor 48. The rotor aperture 258 can be cylindrically shaped to receive the locking pin 306 so that the surface of the rotor aperture 258 closely conforms to an outer surface of the locking pin 306. In addition, the rotor 48 includes an advancing fluid lock pathway 260 that communicates fluid from the advancing chamber of the camshaft phaser 14 to the rotor aperture 258 and a retarding fluid lock pathway 262 that communicates fluid from the retarding chamber of the camshaft phaser 14 to the rotor aperture 258.

The locking pin 306 can slide axially within the rotor aperture 258 to engage a locking feature 308, such as a bore or slot, formed in the stator housing 156. The locking pin 306 can be biased into engagement with the locking feature 308 when the hydraulically-actuated camshaft phaser 14 is neither advancing or retarding camshaft timing such as could occur when the swash plate 302 is not contacting either the first piston or the second piston or the first piston and second piston are positioned to provide equal amounts of fluid in the advancing chamber and the retarding chamber. The locking pin 306 can include an advancing shoulder 310 and a retarding shoulder 312 that is axially spaced from the advancing shoulder 310. The advancing shoulder 310 and the retarding shoulder 312 can each be formed on an outer surface of the locking pin 306 and have substantially perpendicular surfaces. The locking pin 306 can slide axially within the rotor aperture 258 to engage the locking feature 308, such as a bore or slot, formed in the stator housing 152. The locking pin 306 can be biased into engagement with the locking feature 308 when the hydraulically-actuated camshaft phaser 14 is neither advancing or retarding camshaft timing such as could occur when the swash plate 302 is not contacting either the first piston or the second piston or the first piston and second piston are positioned to provide equal amounts of fluid in the advancing chamber and the retarding chamber.

As the swash plate 302 is tilted about the pivot 304 to change the angular position of the camshaft 56 relative to the crankshaft, the swash plate 302 can move the first piston and the second piston relative to the first cylinder 38 and the second cylinder 40, respectively. The tilted swash plate 302 can change the timing of the camshaft 54 and either the advancing chamber or the retarding chamber of the camshaft phaser 14 receives a greater volume and pressure of fluid, which is then communicated with the advancing shoulder 310 or the retarding shoulder 312 to oppose the biasing action of the biasing member 314 and slide the locking pin 306 axially relative to the rotor aperture 258 and move the locking pin 306 from a locked state in which the pin 306 engages the locking feature 308 into in a unlocked state such that the locking pin 306 is not engaged with the locking feature 308 while timing is advanced or retarded. As the swash plate 302 is returned to a position that neither advances or retards the relative camshaft position, fluid pressure and flow from the advancing or retarding chambers subsides and the biasing member 314 overcomes the reduced fluid pressure supplied by either the advancing fluid lock pathway 260 or the retarding fluid lock pathway 262. The locking pin 306 can then be urged into engagement with the locking feature 308 by the biasing member.

It is to be understood that the foregoing is a description of one or more embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "e.g.," "for example," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

What is claimed is:

1. A hydrostatic camshaft phaser system, comprising:
a hydraulically-actuated camshaft phaser that includes:
a rotor having a vane extending radially outwardly from a hub;
a stator housing that receives the rotor and includes an advancing chamber and a retarding chamber defined at least partially by the vane; and
a variable displacement pump, in fluid communication with the hydraulically-actuated camshaft phaser, comprising a first chamber in fluid communication with the advancing chamber and a second chamber in fluid communication with the retarding chamber, wherein the first chamber receives fluid from a first non-continuous groove extending in between a camshaft surface and a bearing surface and the second chamber receives fluid from a second non-continuous groove extending in between the camshaft surface and the bearing surface during a first portion of camshaft rotation, and
wherein the first chamber receives fluid from the second non-continuous groove and the second chamber receives fluid from the first non-continuous groove during a second portion of camshaft rotation.

2. The hydrostatic camshaft phaser system recited in claim 1, wherein the variable displacement pump comprises a first piston received by a first cylinder and a second piston received by a second cylinder.

3. The hydrostatic camshaft phaser system recited in claim 2, further comprising: a camshaft having at least one of the first non-continuous grooves or the second non-continuous grooves and one or more continuous grooves.

4. The hydrostatic camshaft phaser system recited in claim 1, further comprising: a camshaft having one or more non-continuous grooves and one or more continuous grooves.

5. The hydrostatic camshaft phaser system recited in claim 4, further comprising: a first camshaft fluid pathway in fluid communication with the advancing chamber of the hydraulically-actuated camshaft phaser and a second camshaft fluid pathway in fluid communication with the retarding chamber of the hydraulically-actuated camshaft phaser during the first portion of camshaft rotation; and the first camshaft fluid pathway in fluid communication with the retarding chamber of the hydraulically-actuated camshaft phaser and the second camshaft fluid pathway in fluid communication with the advancing chamber of the hydraulically-actuated camshaft phaser during the second portion of camshaft rotation.

6. The hydrostatic camshaft phaser system recited in claim 1, further comprising:
a locking plate, coupled with the rotor, having a plurality of rotor locking teeth;
a locking sleeve having a plurality of rotor teeth and a plurality of stator teeth; and
the stator housing including a plurality of stator locking teeth, wherein the plurality of rotor locking teeth releasably engage the plurality of rotor teeth and the plurality of stator locking teeth releasably engage the plurality of stator teeth.

7. The hydrostatic camshaft phaser system recited in claim 1, further comprising: a swash plate mounted about a pivot that controls the variable displacement pump.

8. The hydrostatic camshaft phaser system recited in claim 7, further comprising: an adjusting member, coupled with the swash plate at the pivot, that moves the swash plate about the pivot.

9. The hydrostatic camshaft phaser system recited in claim 7, further comprising: a plurality of pistons engaging a surface of the swash plate and extending axially through rotor apertures to engage and disengage corresponding locking receivers in a stator plate.

10. The hydrostatic camshaft phaser system recited in claim 1, further comprising: a locking pin, having an advancing shoulder and a retarding shoulder, received by a rotor aperture and biased into engagement with a locking feature in the stator housing by a biasing member;

an advancing fluid lock pathway in fluid communication with the advancing chamber and the rotor aperture; and a retarding fluid lock pathway in fluid communication with the retarding chamber and the rotor aperture, wherein fluid communicated from the advancing fluid lock pathway or the retarding fluid lock pathway to the rotor aperture moves the locking pin out of engagement with the locking feature.

11. The hydrostatic camshaft phaser system recited in claim 1, further comprising: a locking pin, having an advancing shoulder and a retarding shoulder, received by a rotor aperture and biased to remain within the rotor aperture;

an advancing fluid lock pathway in fluid communication with the advancing chamber and the rotor aperture; and a retarding fluid lock pathway in fluid communication with the retarding chamber and the rotor aperture, wherein fluid communicated from the advancing fluid lock pathway or the retarding fluid lock pathway moves the locking pin to extend beyond the rotor aperture and into engagement with a locking feature.

12. A hydrostatic camshaft phaser system, comprising:

a hydraulically-actuated camshaft phaser including:

a stator housing that includes a plurality of sprocket teeth extending radially outwardly from an outer surface of the stator housing; and a rotor, received within the stator housing, configured for connection to a camshaft and comprising at least one vane separating an advancing chamber and a retarding chamber within the stator housing;

a variable displacement pump including:

a first cylinder in fluid communication with the advancing chamber and in fluid communication with a first non-continuous groove in a bearing surface or camshaft surface during a first portion of camshaft rotation, wherein the first cylinder is in fluid communication with a second non-continuous groove in the bearing surface or the camshaft surface during a second portion of camshaft rotation;

a second cylinder in fluid communication with the retarding chamber and in fluid communication with the second non-continuous groove during the first portion of camshaft rotation, wherein the second cylinder is in fluid communication with the first non-continuous groove during the second portion of camshaft rotation; and a first piston received by the first cylinder and a second piston received by the second cylinder, wherein the first piston is displaced relative to the first cylinder and the second piston is displaced relative to the second cylinder to change a phase of the camshaft.

13. The hydrostatic camshaft phaser system recited in claim 12, further comprising a first camshaft pathway in fluid communication with the advancing chamber of the hydraulically-actuated camshaft phaser and a second camshaft fluid pathway in fluid communication with the retarding chamber of the hydraulically-actuated camshaft phaser during the first portion of camshaft rotation; and the first camshaft fluid pathway in fluid communication with the retarding chamber of the hydraulically-actuated camshaft phaser and the second camshaft fluid pathway in fluid communication with the advancing chamber of the hydraulically-actuated camshaft phaser during the second portion of camshaft rotation.

14. The hydrostatic camshaft phaser system recited in claim 12, further comprising:

a locking plate, coupled with the rotor, having a plurality of rotor locking teeth;

a locking sleeve having a plurality of rotor teeth and a plurality of stator teeth; and the stator housing including a plurality of stator locking teeth, wherein the plurality of rotor locking teeth releasably engage the plurality of rotor teeth and the plurality of stator locking teeth releasably engage the plurality of stator teeth.

15. The hydrostatic camshaft phaser system recited in claim 12, further comprising a swash plate mounted about a pivot that controls the variable displacement pump.

16. The hydrostatic camshaft phaser system recited in claim 15, further comprising an adjusting member, coupled with the swash plate at the pivot, that moves the swash plate about the pivot.

17. The hydrostatic camshaft phaser system recited in claim 15, further comprising a plurality of pistons engaging a surface of the swash plate and extending axially through rotor apertures to engage and disengage corresponding locking receivers in a stator plate.

18. The hydrostatic camshaft phaser system recited in claim 12, further comprising a locking pin, having an advancing shoulder and a retarding shoulder, received by a rotor aperture and biased into engagement with a locking feature in the stator housing by a biasing member;

an advancing fluid lock pathway in fluid communication with the advancing chamber and the rotor aperture; and a retarding fluid lock pathway in fluid communication with the retarding chamber and the rotor aperture, wherein fluid communicated from the advancing fluid lock pathway or the retarding fluid lock pathway to the rotor aperture moves the locking pin out of engagement with the locking feature.

19. The hydrostatic camshaft phaser system recited in claim 12, further comprising a locking pin, having an advancing shoulder and a retarding shoulder, received by a rotor aperture and biased to remain within the rotor aperture;

an advancing fluid lock pathway in fluid communication with the advancing chamber and the rotor aperture; and a retarding fluid lock pathway in fluid communication with the retarding chamber and the rotor aperture, wherein fluid communicated from the advancing fluid lock pathway or the retarding fluid lock pathway moves the locking pin to extend beyond the rotor aperture and into engagement with a locking feature.

* * * * *